US008080941B2

(12) United States Patent
Takata

(10) Patent No.: US 8,080,941 B2
(45) Date of Patent: Dec. 20, 2011

(54) COLD CATHODE LAMP, AND ILLUMINATION DEVICE FOR DISPLAY DEVICE AND DISPLAY DEVICE PROVIDED THEREWITH

(75) Inventor: Yoshiki Takata, Suzuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 572 days.

(21) Appl. No.: 12/295,324

(22) PCT Filed: Nov. 27, 2006

(86) PCT No.: PCT/JP2006/323549

§ 371 (c)(1),
(2), (4) Date: Sep. 30, 2008

(87) PCT Pub. No.: WO2007/132542

PCT Pub. Date: Nov. 22, 2007

(65) Prior Publication Data

US 2010/0225254 A1 Sep. 9, 2010

(30) Foreign Application Priority Data

May 12, 2006 (JP) ..... 2006-133633

(51) Int. Cl.

| | |
|---|---|
| ***H01J 17/44*** | (2006.01) |
| ***H01J 61/54*** | (2006.01) |
| ***H01J 11/00*** | (2006.01) |
| ***H01J 61/06*** | (2006.01) |
| ***H05B 37/00*** | (2006.01) |
| ***H05B 41/00*** | (2006.01) |

(52) U.S. Cl. ..... 313/594; 313/234; 313/607; 315/35; 315/324

(58) Field of Classification Search ..... 315/35, 315/324; 313/234, 594, 607, 623–626
See application file for complete search history.

(56) References Cited

U.S. PATENT DOCUMENTS 4,912,368 A * 3/1990 Nishiyama et al. ..... 315/58

(Continued)

FOREIGN PATENT DOCUMENTS

JP 63-098163 A 4/1988

(Continued)

OTHER PUBLICATIONS

Official Communication issued in International Patent Application No. PCT/JP2006/323549, mailed on Dec. 26, 2006.

(Continued)

*Primary Examiner* — Shawki S Ismail
*Assistant Examiner* — Dylan White
(74) *Attorney, Agent, or Firm* — Keating & Bennett, LLP

(57) ABSTRACT

The cold cathode lamp includes a light-transmissive insulating tube; the first and second internal electrodes disposed inside the insulating tube; the first and second external electrodes disposed outside the insulating tube and connected to the first and second internal electrodes, respectively; the first and second insulating members covering the first and second external electrodes, respectively; the first opposite electrode opposite the first external electrode with the first insulating member interposed therebetween, the second opposite electrode opposite the second external electrode with the second insulating member interposed therebetween, the first insulating layer covering the outer edges of the first opposite electrode; and the second insulating layer covering the outer edges of the second opposite electrode. It is possible to light up a plurality of cold cathode lamps that are connected in parallel to a power supply. It is also possible to suppress the generation of a corona discharge around the outer edges of the opposite electrode.

10 Claims, 10 Drawing Sheets

U.S. PATENT DOCUMENTS

| | | | | |
|---|---|---|---|---|
| 5,387,837 | A | 2/1995 | Roelevink et al. | |
| 5,705,879 | A | 1/1998 | Abe et al. | |
| 5,982,089 | A | 11/1999 | Wesselink et al. | |
| 7,638,945 | B2 * | 12/2009 | Takata | 313/607 |
| 2003/0214478 | A1 | 11/2003 | Yoo et al. | |
| 2004/0239260 | A1 | 12/2004 | Nakano | |
| 2006/0197424 | A1 | 9/2006 | Takata | |
| 2008/0259602 | A1 * | 10/2008 | Fechner et al. | 362/247 |
| 2009/0207585 | A1 * | 8/2009 | Kamada | 362/97.1 |
| 2009/0256480 | A1 * | 10/2009 | Kim et al. | 313/624 |
| 2010/0066272 | A1 * | 3/2010 | Takata | 315/326 |
| 2010/0084977 | A1 * | 4/2010 | Iwamoto | 315/59 |
| 2010/0109544 | A1 * | 5/2010 | Hayashi | 315/246 |
| 2010/0225253 | A1 * | 9/2010 | Takata | 315/324 |

FOREIGN PATENT DOCUMENTS

| | | | |
|---|---|---|---|
| JP | 02-041362 | U | 3/1990 |
| JP | 02-057539 | U | 4/1990 |
| JP | 03-261067 | A | 11/1991 |
| JP | 05-121049 | A | 5/1993 |
| JP | 05-275060 | A | 10/1993 |
| JP | 09-017329 | A | 1/1997 |
| JP | 11-040109 | A | 2/1999 |
| JP | 2003-257377 | A | 9/2003 |
| JP | 2004-039264 | A | 2/2004 |
| JP | 2004-039336 | A | 2/2004 |

OTHER PUBLICATIONS

Takata: "Cold-Cathode Lamp, and Display Illumination Device and Display Device Therewith," U.S. Appl. No. 12/295,311, filed Sep. 30, 2008.

Takata: "Illumination Device for Display Device and Display Device Provided Therewith," U.S. Appl. No. 12/295,384, filed Sep. 30, 2008.

Takata: "Illuminating Apparatus for Display Device and Display Device Having Same," U.S. Appl. No. 12/296,453, filed Oct. 8, 2008.

Takata: "Holding Member, Illumination Device for Display Device Having the Holding Member, and Display Device Having the Holding Member," U.S. Appl. No. 12/300,652, filed Nov. 13, 2008.

* cited by examiner

COLD CATHODE LAMP, AND ILLUMINATION DEVICE FOR DISPLAY DEVICE AND DISPLAY DEVICE PROVIDED THEREWITH

BACKGROUND OF THE INVENTION

1. Field of the Invention

The present invention relates to cold cathode lamps.

2. Description of the Related Art

The schematic cross-sectional view of a conventional cold cathode lamp is shown in FIG. 14. The conventional cold cathode lamp shown in FIG. 14 has internal electrodes 2 and 3 inside a glass tube 1. Parts of the internal electrodes 2 and 3 penetrate the glass tube 1 to protrude outward from the glass tube 1, and they serve as electrode terminals. The glass tube 1 configured as described above is hermetically sealed. The inner wall of the glass tube 1 is coated with fluorescent material. Generally, neon and argon are sealed in the glass tube 1 in the proportion of 95 to 5 or 80 to 20 or in other proportions such that the overall pressure inside the glass tube 1 falls within the range of $5.3\times10^3$ to $10.7\times10^3$ Pa (≈40 to 80 torr), and a few milligrams of mercury is further sealed in the glass tube 1. Instead of mercury, xenon may be sealed in the glass tube 1.

When a lamp voltage (a voltage between the internal electrodes) reaches a discharge start voltage Vs, a discharge is started. The discharge causes mercury or xenon to generate ultraviolet rays, and the generated ultraviolet rays cause the fluorescent material coated on the inner wall in the glass tube 1 to emit light.

The conventional cold cathode lamp shown in FIG. 14 acts, in terms of its equivalent circuit, as a resistor whose resistance nonlinearly decreases with increasing current. The conventional cold cathode lamp has a nonlinear negative impedance characteristic such as a V-I characteristic shown in FIG. 15 (for example, see patent document 3).

One application of the conventional cold cathode lamp shown in FIG. 14 is a backlight for use in a liquid crystal display device. When the display screen of the liquid crystal display device is large, a plurality of cold cathode lamps are arranged for use in the liquid crystal display device. In this case, if parallel driving is achieved in a plurality of cold cathode lamps, an equal voltage is applied to all the cold cathode lamps, with the result that only one power supply is needed.

Here, consider a case where a plurality of (for example, three) cold cathode lamps in parallel are driven together. The V-I characteristics vary from one cold cathode lamp to another. Thus, the V-I characteristic curves T1 to T3 of the first to third cold cathode lamps are assumed to be as shown in FIG. 16. An equal alternating-current voltage is applied to the first to third cold cathode lamps, and the alternating-current voltage is then stepped up. When the stepped up alternating-current voltage reaches the discharge start voltage $V_{S1}$ of the first cold cathode lamp, the first cold cathode lamp lights up, and the voltage across the first cold cathode lamp is dropped according to its nonlinear negative impedance characteristic. Since the voltages across the second and third cold cathode lamps are equal to that across the first cold cathode lamp, the above-mentioned alternating-current voltage does not reach the discharge start voltage $V_{S2}$ of the second cold cathode lamp and the discharge start voltage $V_{S3}$ of the third cold cathode lamp. That is, when a plurality of cold cathode lamps in parallel are simply driven together, only one cold cathode lamp can be lit. Thus, one power supply is generally provided for each cold cathode lamp so that a plurality of cold cathode lamps are lit. Disadvantageously, however, with such a configuration, as many power supplies as there are cold cathode lamps are required, and this results in a higher cost. It is also disadvantageous in terms of compactness, lightness and cost. Since cold cathode lamps are generally connected to power supplies through wiring harness (also called lead wires) and connectors, the following disadvantages arise. The mounting of cold cathode lamps is time-consuming, and this results in low efficiency with which an illumination device or the like incorporating cold cathode lamps is assembled. The removal of cold cathode lamps is also time-consuming, and this results in low efficiency with which a cold cathode lamp is replaced or an illumination device or the like incorporating cold cathode lamps is disassembled after being disposed of.

To overcome these disadvantages, external electrode fluorescent lamps (EEFLs) are being developed (for example, see patent documents 1 and 2). The schematic cross-sectional view of the external electrode fluorescent lamp is shown in FIG. 17. In FIG. 17, such parts as are found also in FIG. 14 are identified with common reference numerals, and their detailed description will not be repeated. The external electrode fluorescent lamp shown in FIG. 17 differs from the conventional cold cathode lamp shown in FIG. 14 in that the internal electrodes 2 and 3 are removed, and external electrodes 4 and 5 are formed on the ends of the glass tube 1. The glass tube 1 configured as described above is hermetically sealed.

In the external electrode fluorescent lamp shown in FIG. 17, when a lamp voltage (a voltage between the external electrodes) reaches a discharge start voltage Vs', a discharge is started. The discharge causes mercury or xenon to generate ultraviolet rays, and the generated ultraviolet rays cause the fluorescent material coated on the inner wall in the glass tube 1 to emit light.

Since the interior of the glass tube 1 has a nonlinear negative impedance characteristic, and the external electrodes are insulated from the interior of the glass tube 1 by glass, the external electrode fluorescent lamp shown in FIG. 17 acts, in terms of its equivalent circuit, as a series connected member in which a capacitor is connected to each end of a resistor whose resistance nonlinearly decreases with increasing current. Thus, the external electrode fluorescent lamp shown in FIG. 17, as a whole, has a nonlinear positive impedance characteristic like a V-I characteristic shown in FIG. 18.

Here, consider a case where a plurality of (for example, three) external electrode fluorescent lamps in parallel are driven together. The V-I characteristics vary from one external electrode fluorescent lamp to another. Thus, the V-I characteristic curves T1' to T3' of the first to third external electrode fluorescent lamps are assumed to be as shown in FIG. 19. An equal alternating-current voltage is applied to the first to third external electrode fluorescent lamps, and the alternating-current voltage is then stepped up. When the stepped up alternating-current voltage reaches the discharge start voltage $V_{S1}'$ of the first external electrode fluorescent lamp, the first external electrode fluorescent lamp lights up. Thereafter, as the output of a power supply increases, the alternating-current voltage is increased. Then, when the alternating-current voltage reaches the discharge start voltage $V_{S2}'$ of the second external electrode fluorescent lamp, the second external electrode fluorescent lamp lights up. Then, when the alternating-current voltage reaches the discharge start voltage $V_{S3}'$ of the third external electrode fluorescent lamp, the third external electrode fluorescent lamp lights up. That is, even when a plurality of external electrode fluorescent lamps in parallel are simply driven together, all the external electrode fluorescent lamps can be lit.

In an illumination device or the like incorporating the external electrode fluorescent lamps, since the external electrodes are provided on the perimeter of the glass tube, by the elastic action of a holder formed by an elastic metal member (made of, for example, spring steel), the external electrodes of the external electrode fluorescent lamp are held by the holder. Thus, it is possible to supply power to the external electrode fluorescent lamps through the holders. This configuration is advantageous in that the mounting and removal of the external electrode fluorescent lamp is facilitated.

Patent document 1: JP-A-2004-031338
Patent document 2: JP-A-2004-039264
Patent document 3: JP-A-H07-220888 (FIG. 4)
Patent document 4: JP-A-2004-039336
Patent document 5: JP-A-H05-121049
Patent document 6: JP-A-S64-082452
Patent document 7: JP-A-2003-100482
Patent document 8: JP-A-H11-040109
Patent document 9: JP-UM-A-H02-041362
Patent document 10: JP-A-H06-084499

Disadvantageously, however, since the glass interposed between the external electrodes and the space inside the glass tube corresponds to a dielectric sandwiched between the electrodes of a capacitor that is one of the elements in the equivalent circuit of the external electrode fluorescent lamp, charged particles collide with the portions of the inner wall of the glass tube opposite the external electrodes, and the inner wall is locally sputtered. Once the inner wall is sputtered, the capacitance of the sputtered portions is increased, and thus charged particles collide with the sputtered portions in a concentrated manner, with the result that pinholes are formed. This makes it difficult to maintain the sealed condition of the glass tube. As described above, the external electrode fluorescent lamps have poor reliability.

SUMMARY OF THE INVENTION

In order to overcome the problems described above, preferred embodiments of the present invention provide highly reliable cold cathode lamps that allow parallel lighting by parallel driving and provide an illumination device for a display device and a display device incorporating such cold cathode lamps.

According to a preferred embodiment of the present invention, a cold cathode lamp, when mounted, has electric power supplied through first and second conducting members disposed externally, and includes: an insulating tube formed of a light-transmissive insulating material (where part of light may be interrupted or part or all of light may be attenuated as long as light is transmitted such that the cold cathode lamp serves as a lamp); a first internal electrode disposed inside the insulating tube; a second internal electrode disposed inside the insulating tube; a first external electrode disposed outside the insulating tube and connected to the first internal electrode so as to have the same potential as that of the first internal electrode; a first insulating member; a fist opposite electrode opposite the first external electrode with the first insulating member interposed therebetween; and a first insulating layer covering at least part of an outer edge of the first opposite electrode. Here, the first conducting member is electrically connected to the first opposite electrode when the cold cathode lamp is mounted (hereinafter, "the first configuration"). Examples of the insulating tube formed of the light-transmissive insulating material include a glass tube and a resin tube. Examples of the method for connecting the internal electrode to the external electrode include: a method in which part of the internal electrode penetrates the insulating tube to protrude outward from the insulating tube and thereby makes connection with the external electrode; a method in which part of the external electrode penetrates the insulating tube to protrude inward from the insulating tube and thereby makes connection with the internal electrode; and a method in which the conducting member penetrates the insulating tube to protrude inward and outward from the insulating tube and thereby makes connections with the internal and external electrodes. In any method described above, the insulating tube is hermetically insulated.

With this configuration, the cold cathode lamp of the first configuration acts, in terms of its equivalent circuit, a series connected member in which a capacitor (hereinafter, also called "ballast capacitor") is connected to at least one end of a resistor whose resistance nonlinearly decreases with increasing current. Thus, the cold cathode lamp has a nonlinear positive impedance characteristic, and this allows parallel lighting by parallel driving of the cold cathode lamp of the first configuration. The first opposite electrode is located at a given distance from the first external electrode, and thus a capacitor defined by the first external electrode and first opposite electrode can be stabilized. The first insulating layer covering at least part of the outer edge of the first opposite electrode is provided. Thus, it is possible to suppress the generation of a corona discharge around the outer edge of the first opposite electrode. This helps increase the reliability of the cold cathode lamp.

The cold cathode lamp of the first configuration may further include a second external electrode disposed outside the insulating tube and connected to the second internal electrode so as to have the same potential as that of the second internal electrode; a second insulating member; a second opposite electrode opposite the second external electrode with the second insulating member interposed therebetween; and a second insulating layer covering at least part of an outer edge of the second opposite electrode. Here, the second conducting member is electrically connected to the second opposite electrode when the cold cathode lamp is mounted (hereinafter, "the second configuration").

With this configuration, the cold cathode lamp of the second configuration acts, in terms of its equivalent circuit, as a series connected member in which a capacitor (hereinafter, also called "ballast capacitor") is connected to each end of a resistor whose resistance nonlinearly decreases with increasing current. Thus, the cold cathode lamp has a nonlinear positive impedance characteristic, and this allows parallel lighting by parallel driving of the cold cathode lamp of the second configuration. The first opposite electrode is located at a given distance from the first external electrode and the second opposite electrode is located at a given distance from the second external electrode, and thus a capacitor formed by the first external electrode and the first opposite electrode and a capacitor formed by the second external electrode and second opposite electrode can be stabilized. The first insulating layer covering at least part of the outer edge of the first opposite electrode and the second insulating layer covering at least part of the outer edge of the second opposite electrode are provided. Thus, it is possible to suppress the generation of a corona discharge around the outer edges of the first and second opposite electrodes. This helps increase the reliability of the cold cathode lamp.

In the cold cathode lamp of the first configuration, the entire first external electrode may be covered by the insulating tube and the first insulating member (hereinafter, "the third configuration").

With this configuration, it is possible to prevent a creeping discharge on the edge of the first external electrode. This helps increase dielectric strength.

In the cold cathode lamp of the second configuration, the entire first external electrode may be covered by the insulating tube and the first insulating member, and the entire second external electrode may be covered by the insulating tube and the second insulating member (hereinafter, "the fourth configuration").

With this configuration, it is possible to prevent a creeping discharge on the edges of the first and second external electrodes. This helps increase dielectric strength.

In the cold cathode lamp of the first configuration or the third configuration, the first opposite electrode may have a projection, and the first conducting member and the projection of the first opposite electrode may make contact with each other when the cold cathode lamp is mounted (hereinafter, "the fifth configuration").

With this configuration, it is possible to ensure electrical connection between the first conducting member and the first opposite electrode when the cold cathode lamp is mounted.

In the cold cathode lamp of the second configuration or the fourth configuration, the first opposite electrode may have a projection, and the first conducting member and the projection of the first opposite electrode may make contact with each other when the cold cathode lamp is mounted, and the second opposite electrode may have a projection, and the second conducting member and the projection of the second opposite electrode may make contact with each other when the cold cathode lamp is mounted (hereinafter, "the sixth configuration").

With this configuration, it is possible to ensure both electrical connection between the first conducting member and the first opposite electrode when the cold cathode lamp is mounted and electrical connection between the second conducting member and the second opposite electrode when the cold cathode lamp is mounted According to various preferred embodiments of the present invention, an illumination device for a display device includes the cold cathode lamp of any one of the first to sixth configurations; a first conducting member and a second conducting member; and a power supply supplying electric power to the cold cathode lamp through the first and second conducting members (hereinafter, "the seventh configuration").

With this configuration, it is possible to allow parallel lighting by parallel driving of the cold cathode lamp. Thus, it is possible to achieve compactness, light weight and low cost. It is also possible to suppress the generation of a corona discharge around the outer edge of the opposite electrode in the cold cathode lamp. This helps increase the reliability of the cold cathode lamp.

The illumination device for a display device of the seventh configuration may include a plurality of the cold cathode lamps. Here, part or the whole of the plurality of the cold cathode lamps are electrically connected in parallel (hereinafter, "the eighth configuration").

With this configuration, it is possible to reduce the number of power supplies mentioned previously. Thus, it is possible to achieve compactness, light weight and low cost.

In the illumination device for a display device of the eighth configuration, a voltage applied to first internal electrodes in the cold cathode lamps connected in parallel may be substantially 180 degrees out of phase with a voltage applied to second internal electrodes in the cold cathode lamps connected in parallel (hereinafter, "the ninth configuration").

With this configuration, a brightness gradient caused by a leakage current following through a conductor (for example, a metal enclosure of the illumination device for a display device) located close to a parallel-connected power supply line is symmetric. Thus, it is possible to improve the quality of illumination. Moreover, with this configuration, when the illumination device for a display device is incorporated in a display device, a voltage that affects display elements (for example, display elements in a liquid crystal panel) located close to the parallel-connected power supply line theoretically becomes zero. Thus, it is possible to cancel out noise occurring in the display elements and attributable to the illumination device for a display device.

According to another preferred embodiment of the present invention, a display device includes the illumination device for a display device of any one of the seventh to ninth configurations.

With this configuration, it is possible to allow parallel lighting by parallel driving of the cold cathode lamp. Thus, it is possible to achieve compactness, light weight and low cost. It is also possible to suppress the generation of a corona discharge around the outer edge of the opposite electrode in the cold cathode lamp. This helps increase the reliability of the cold cathode lamp.

According to various preferred embodiments of the present invention, a cold cathode lamp acts, in terms of its equivalent circuit, as a series connected member in which a capacitor is connected to at least one end of a resistor whose resistance nonlinearly decreases with increasing current. Thus, the cold cathode lamp has a nonlinear positive impedance characteristic, and this allows parallel lighting by parallel driving of the cold cathode lamp. According to preferred embodiments of the invention, it is possible to suppress the generation of a corona discharge around the outer edge of the opposite electrode in the cold cathode lamp. This helps increase the reliability of the cold cathode lamp.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, preferred embodiments of the present invention will be described with reference to the accompanying drawings. The internal structure (including a sealed-in material) of a cold cathode lamp according to preferred embodiments of the present invention is not essential for the present invention, and various conventional technologies can be applied to the internal structure. Thus, its detailed description will be omitted.

Figure 1:
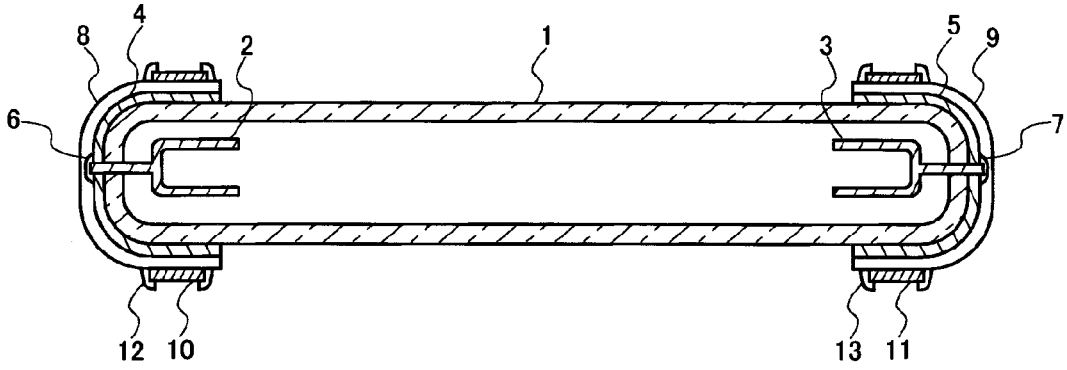
FIG. 1 is a schematic cross-sectional view showing a cold cathode lamp according to a preferred embodiment of the present invention.
Figure 14:
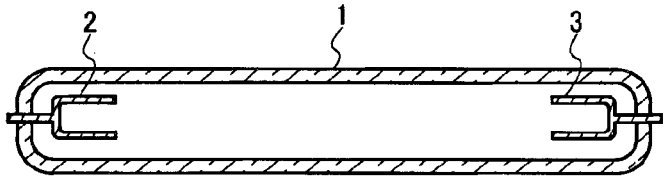
FIG.14 PRIOR ART
FIG. 14 is a schematic cross-sectional view showing a conventional cold cathode lamp.
Figure 15:
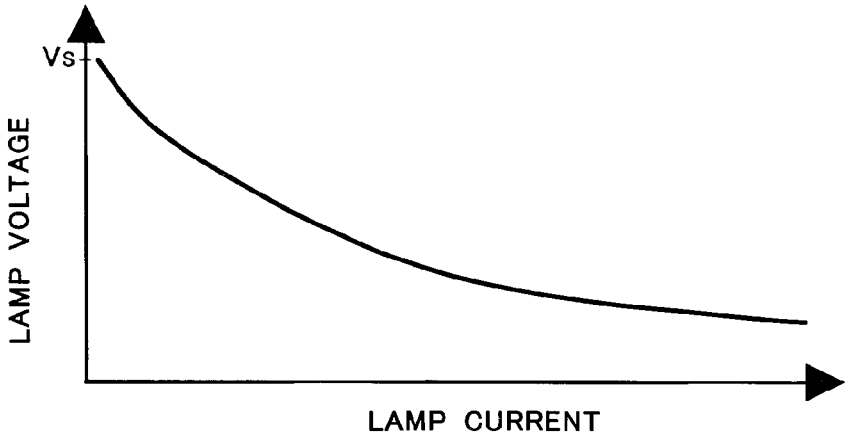
FIG.15 PRIOR ART
FIG. 15 is a diagram showing the V-I characteristic of the conventional cold cathode lamp shown in FIG. 14.
Figure 16:
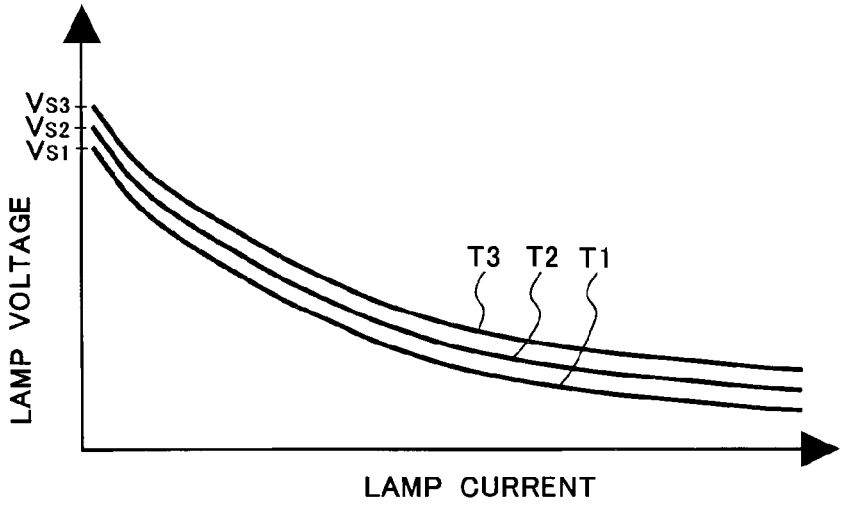
FIG.16 PRIOR ART
FIG. 16 is a diagram showing the V-I characteristic of a plurality of conventional cold cathode lamp.

The schematic cross-sectional view of the cold cathode lamp according to a preferred embodiment of the present invention is shown in FIG. 1. In FIG. 1, elements that are found also in FIG. 14 are identified with common reference numerals, and their detailed description will not be repeated. The cold cathode lamp shown in FIG. 1 differs from the conventional cold cathode lamp shown in FIG. 14 in the following respects. External electrodes 4 and 5 are provided at the ends of the glass tube 1 in the conventional cold cathode lamp shown in FIG. 14; a protrusion of an internal electrode 2 and the external electrode 4 are joined together with solder 6; a protrusion of an internal electrode 3 and the external electrode 5 are joined together with solder 7; insulating layers 8 and 9 are formed on the external electrodes 4 and 5, respectively; annular band-shaped opposite electrodes 10 and 11 are formed on the insulating layers 8 and 9, respectively; and a corona discharge prevention insulating layer 12 covering all the outer edges of the opposite electrode 10 and a corona discharge prevention insulating layer 13 covering all the outer edges of the opposite electrode 11 are provided. Specific examples of the external electrodes 4 and 5 include a metal paste, a metal foil and a metal cap. Examples of materials for the insulating layers 8 and 9 and the corona discharge prevention insulating layers 12 and 13 include inorganic ceramic and resin. The materials for the insulating layer 8 and the corona discharge prevention insulating layer 12 may be the same as each other or different from each other. Likewise, the materials for the insulating layer 9 and the corona discharge prevention insulating layer 13 may be the same as each other or different from each other. The solder 6 and 7 may be omitted as long as sufficient electrical connection is provided between the protrusion of the internal electrode 2 and the external electrode 4 and between the protrusion of the internal electrode 3 and the external electrode 5.

An illumination device for a display device according to a preferred embodiment of the present invention is provided with the cold cathode lamp shown in FIG. 1, an illumination unit and an optical sheet. The cold cathode lamp shown in FIG. 1 is fitted into a holder disposed in front of the illumination unit; the front of the illumination unit into which the cold cathode lamp shown in FIG. 1 is fitted is covered with the optical sheet.

Figure 2A:
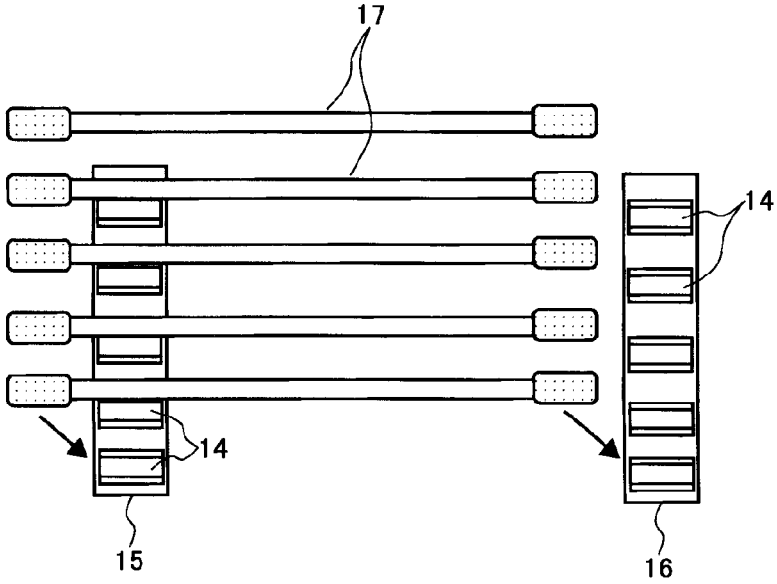
FIG. 2A is a diagram showing how the cold cathode lamps according to a preferred embodiment of the present invention are fitted into holders.
Figure 2B:
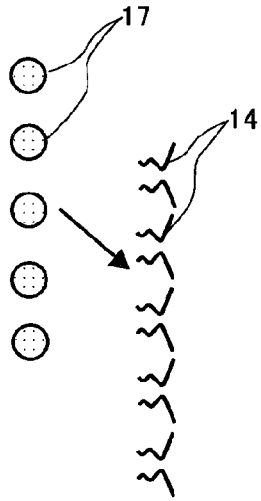
FIG. 2B is a diagram showing how the cold cathode lamps according to a preferred embodiment of the present invention are fitted into the holders.

How the cold cathode lamp shown in FIG. 1 is fitted into the holder is now shown in FIGS. 2A and 2B. FIG. 2A is a front view; FIG. 2B is a side view.

A plurality of pairs of holders 14 are disposed in front of the illumination unit; a power supply (unillustrated) is disposed behind the illumination unit. The power supply outputs an alternating-current voltage having a frequency of several tens of kilohertz. The holders 14 disposed in the left front end portion 15 of the illumination unit and connected together are connected to one end of the power supply; the holders 14 disposed in the right front end portion 16 of the illumination unit and connected together are connected to the other end of the power supply. The holders 14 are formed by elastic metal members (made of, for example, spring steel); they hold the opposite electrodes in the cold cathode lamps shown in FIG. 1 by the elastic action of the elastic metal members. Thus, the holders 14 and the opposite electrodes 10 and 11 in the cold cathode lamp 17 shown in FIG. 1 are electrically connected to each other. With this configuration, it is possible to connect the cold cathode lamp shown in FIG. 1 to the power supply without the use of wiring harness (also called lead wires) and connectors.

Figure 17:
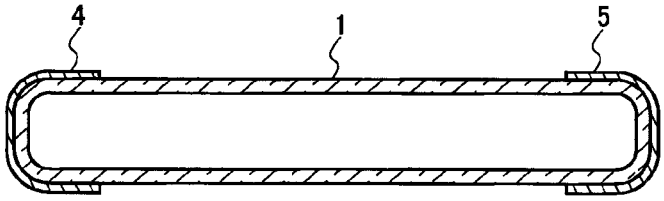
FIG.17 PRIOR ART
FIG. 17 is a schematic cross-sectional view showing an external electrode fluorescent lamp.
Figure 18:
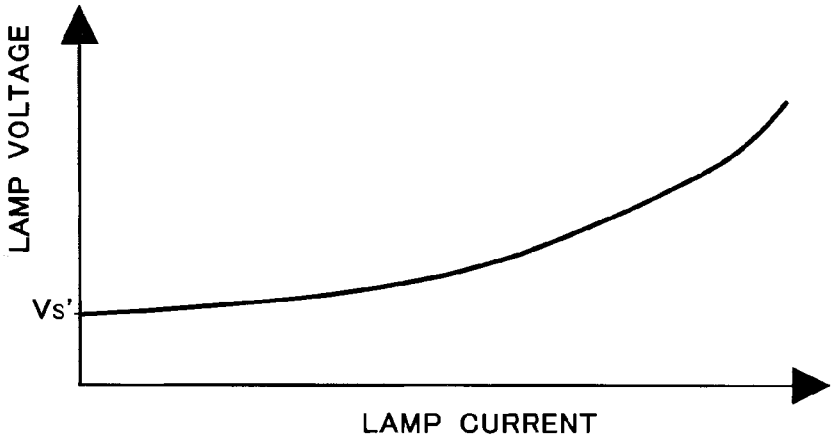
FIG.18 PRIOR ART
FIG. 18 is a diagram showing the V-I characteristic of the external electrode fluorescent lamp shown in FIG. 17.
Figure 19:
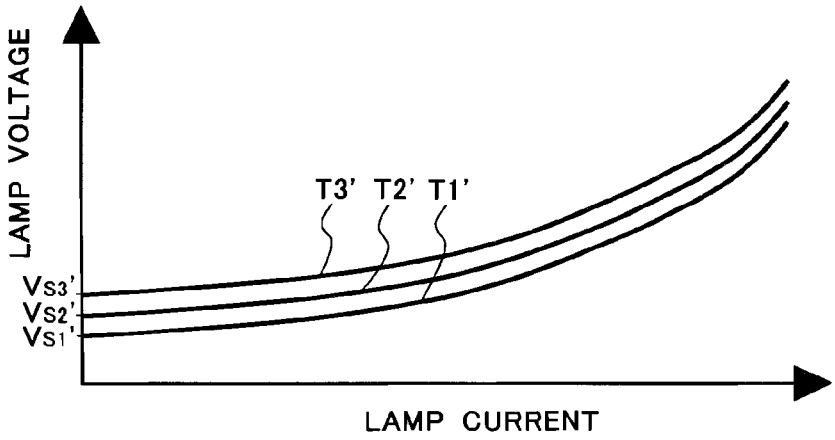
FIG.19 PRIOR ART
FIG. 19 is a diagram showing the V-I characteristic of a plurality of external electrode fluorescent lamps.

In the cold cathode lamp 17 shown in FIG. 1 (hereinafter, "cold cathode lamp 17"), a capacitor including the external electrode 4 and the opposite electrode 10 in the cold cathode lamp 17 and a capacitor including the external electrode 5 and the opposite electrode 11 in the cold cathode lamp 17 are formed. Thus, the cold cathode lamp 17 acts, in terms of its equivalent circuit, as a series connected member in which a capacitor is connected to each end of a resistor whose resistance nonlinearly decreases with increasing current. Like the external electrode fluorescent lamp shown in FIG. 17, the series connected member has a nonlinear positive impedance characteristic. Hence, even when a plurality of cold cathode lamps 17 in parallel are driven together, all the cold cathode lamps 17 light up. Since the internal electrodes and the external electrodes in the cold cathode lamp 17 are directly connected to each other, a parasitic capacitor or the like formed between wiring harness (also called lead wires) and the conductive enclosure of the illumination unit is not present between the resistor and the capacitors in the equivalent circuit. This makes it easier to reduce variations in lamp current flowing between the cold cathode lamps 17.

In the cold cathode lamp 17, since charged particles do not collide with the portions of the inner wall of the glass tube opposite the external electrodes, it is unlikely that pinholes are formed in the glass tube like the external electrode fluorescent lamp. In the cold cathode lamp 17, charged particles collide with the internal electrodes, and this causes the internal electrodes to be sputtered. This sputtering occurs when charged particles reach, since the internal electrodes have the same potential, a portion close to the discharge region in the internal electrode like a lighting rod. As the sputtering proceeds, the portion close to the discharge region in the internal electrode varies. Thus, unlike the external electrode fluorescent lamp shown in FIG. 17, the sputtering does not occur in a concentrated manner. Hence, the lamp life depends on the physical size of the internal electrode.

In the cold cathode lamp 17, the capacitor composed of the external electrode 4 and the opposite electrode 10 in the cold cathode lamp 17 and the capacitor composed of the external electrode 5 and the opposite electrode 11 in the cold cathode lamp 17 are formed, and the opposite electrodes 10 and 11 are located at given distances from the external electrodes 4 and 5. Thus, it is possible to stabilize the capacitor composed of the external electrode 4 and the opposite electrode 10 in the cold cathode lamp 17 and the capacitor composed of the external electrode 5 and the opposite electrode 11 in the cold cathode lamp 17.

Electric flux lines produced by electric charges on the external electrode 4 and the opposite electrode 10 are composed of not only electric flux lines extending linearly between the external electrode 4 and the opposite electrode 10 but also electric flux lines extending curvedly to the outer edges of the opposite electrode 10. Hence, unless the corona discharge prevention insulating layer 12 is provided, an electrical breakdown may be produced in an air layer around the outer edges of the opposite electrode 10, depending on the conditions of applied voltage. Thus, the electrical breakdown causes a corona discharge around the outer edges of the opposite electrode 10. When a corona discharge occurs around the outer edges of the opposite electrode 10, the opposite electrode 10 and the insulating layer 8 are damaged due to the heat generated, and ozone is produced. This reduces the reliability of the cold cathode lamp.

Hence, the cold cathode lamp 17 is provided with the corona discharge prevention insulating layer 12 covering the outer edges of the opposite electrode 10 to remove the air layer around the outer edges of the opposite electrode 10. Thus, a corona discharge is prevented. Moreover, since the corona discharge prevention insulating layer 12 has a higher permittivity than the air layer, it draws in electric flux lines. This produces the effect of preventing electric flux lines from extending curvedly to the air layer around the corona discharge prevention insulating layer 12.

For the same purpose, the cold cathode lamp 17 is provided with the corona discharge prevention insulating layer 13 covering the outer edges of the opposite electrode 11.

Figure 3:
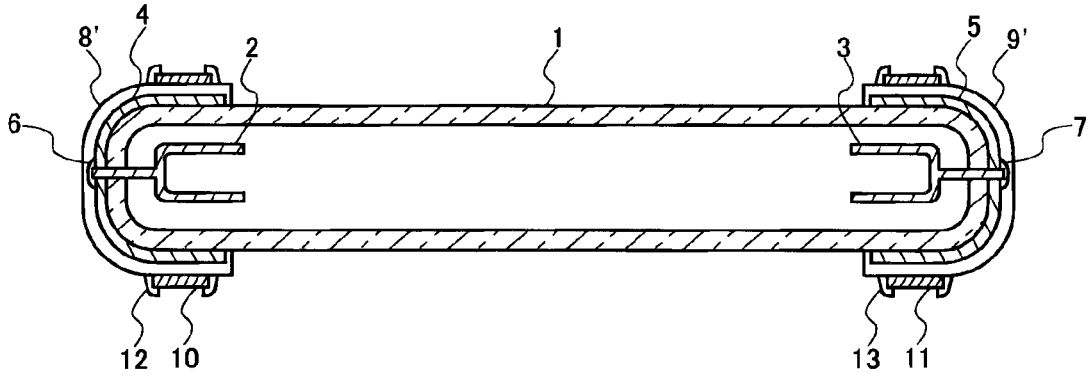
FIG. 3 is a diagram showing a modified example of the cold cathode lamp according to a preferred embodiment of the present invention.

The insulating layer in the cold cathode lamp 17 is arranged so that the external electrode does not make direct contact with the opposite electrode. From the standpoint of preventing a discharge between the external electrode and the opposite electrode in the cold cathode lamp 17, and especially from the standpoint of preventing a creeping discharge on the edges of the external electrode, it is preferable that a cold cathode lamp shown in FIG. 3 be used instead of the cold cathode lamp shown in FIG. 1. In FIG. 3, such elements as are found also in FIG. 1 are identified with common reference numerals, and their detailed description will not be repeated. In the cold cathode lamp shown in FIG. 3, the entire external electrode 4 is covered with the glass tube 1 and the insulating layer 8', and the entire external electrode 5 is covered with the glass tube 1 and the insulating layer 9'.

Figure 4A:
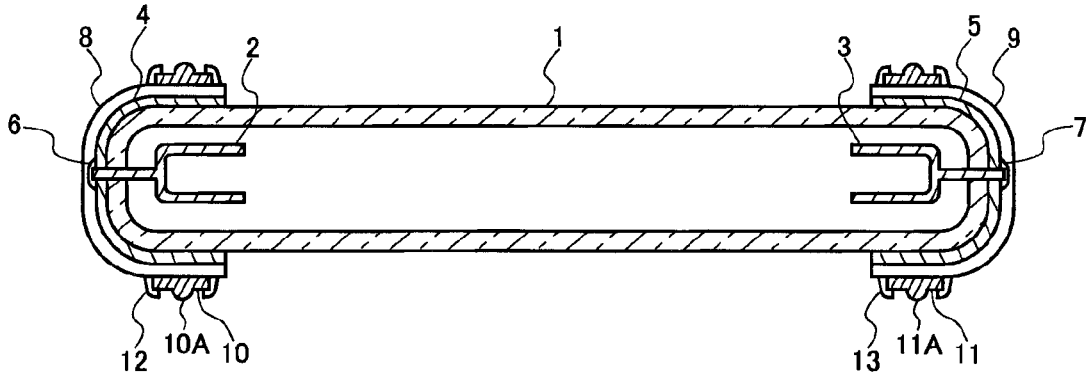
FIG. 4A is a diagram showing another modified example of the cold cathode lamp according to a preferred embodiment of the present invention.
Figure 4B:
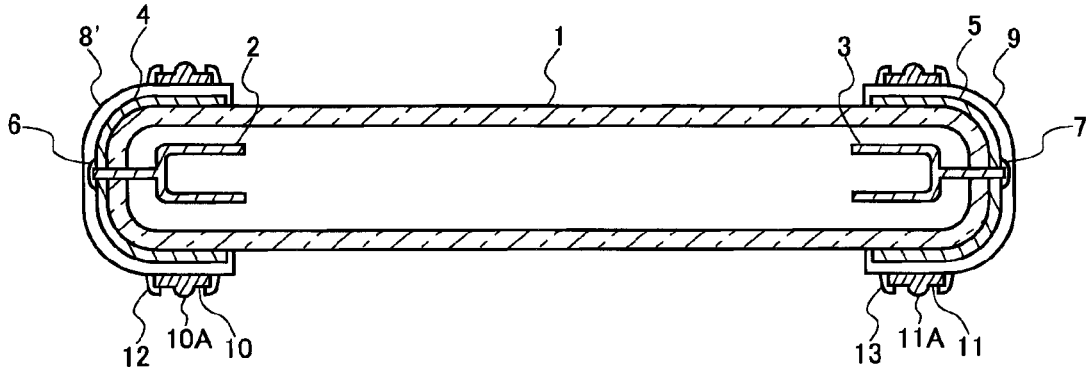
FIG. 4B is a diagram showing another modified example of the cold cathode lamp according to a preferred embodiment of the present invention.

The opposite electrodes 10 and 11 in the cold cathode lamp 17 and the holders 14 need to be electrically connected to each other. Thus, preferably, in order to ensure that the opposite electrodes 10 and 11 in the cold cathode lamp 17 and the holders 14 are electrically connected to each other, as shown in FIGS. 4A and 4B, annular projections 10A and 11A are provided on the annular band-shaped opposite electrodes 10 and 11, and the annular projections 10A and 11A make contact with the holders 14 when the cold cathode lamp 17 is mounted.

Figure 5:
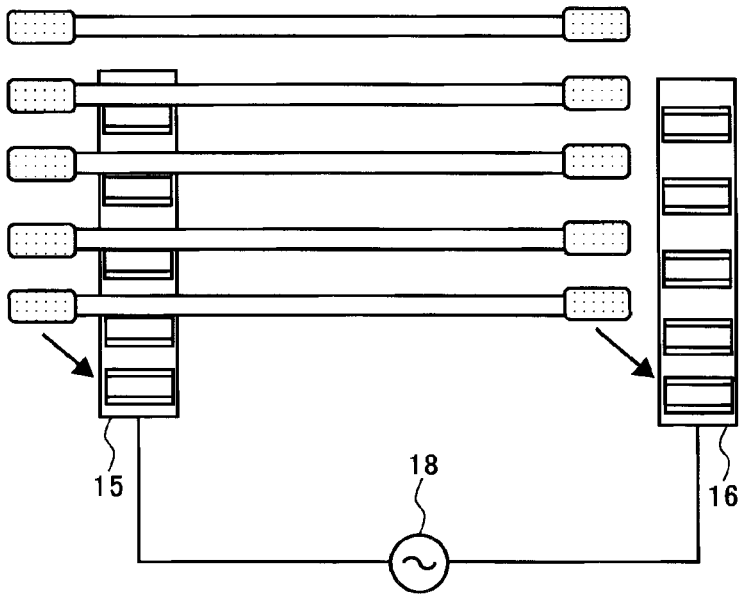
FIG. 5 is a diagram showing an example of the arrangement of a power supply in an illumination device for a display device according to a preferred embodiment of the present invention.
Figure 6:
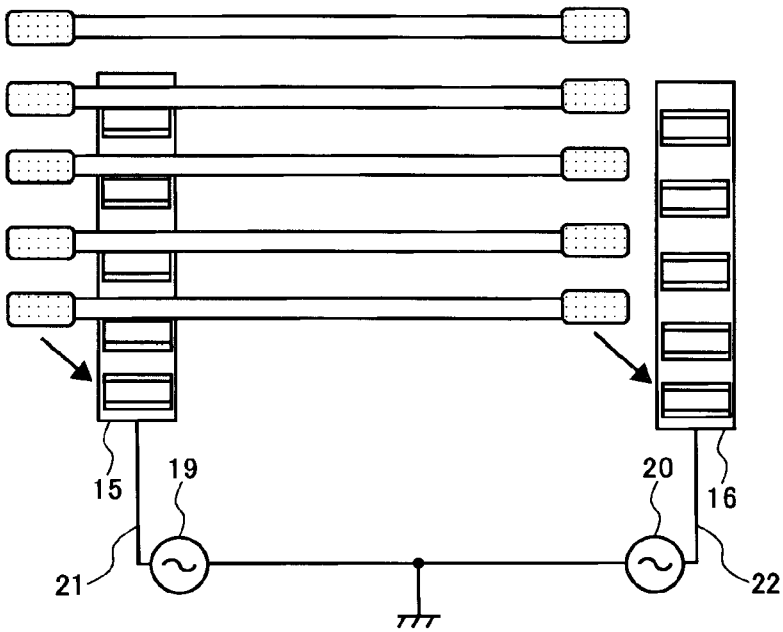
FIG. 6 is a diagram showing an example of the arrangement of power supplies in the illumination device for a display device according to a preferred embodiment of the present invention.

A description will now be given of an example of the arrangement of a power supply in the illumination device for a display device according to a preferred embodiment of the present invention. In an example of the arrangement of a power supply shown in FIG. 5, the holders disposed in the left front end portion 15 of the illumination unit and connected together are connected to one end of the power supply 18. The holders disposed in the right front end portion 16 of the illumination unit and connected together are connected to the other end of the power supply 18. The power supply 18 is provided behind the illumination unit and outputs an alternating-current voltage having a frequency of several tens of kilohertz. In contrast, in an example of the arrangement of power supplies shown in FIG. 6, the holders disposed in the left front end portion 15 of the illumination unit and connected together are connected to one end of the power supply 19. The holders disposed in the right front end portion 16 of the illumination unit and connected together are connected to one end of the power supply 20. The other ends of the power supplies 19 and 20 are grounded. The power supplies 19 and 20 are provided behind the illumination unit and output an alternating-current voltage having a frequency of several tens of kilohertz. With the example of the arrangement of the power supplies shown in FIG. 6, it is possible to reduce the wiring length of high-voltage lines 21 and 22 that carry high voltage. This helps stabilize lamp current and reduce power dissipation.

In the illumination device for a display device according to a preferred embodiment of the present invention, it is preferable that one power supply drive all cold cathode lamps in parallel, in terms of reduction in the number of power supplies used. In consideration of the capacity of power supplies and the number of cold cathode lamps used, however, the configuration in which one power supply drives all the cold cathode lamps in parallel may not be employed, the cold cathode lamps may be divided into a plurality of groups and for each group, a power supply may be provided that drives all cold cathode lamps in parallel in each group.

A voltage applied to the internal electrodes on one side of the cold cathode lamps electrically connected in parallel may be substantially 180 degrees out of phase with a voltage applied to the internal electrodes on the other side. With this configuration, a brightness gradient caused by a leakage current following through a conductor (for example, a metal enclosure of the illumination device for a display device) located close to a parallel-connected power supply line is symmetric. Thus, it is possible to improve the quality of illumination. Moreover, with this configuration, when the illumination device for a display device is incorporated in a display device, a voltage that affects display elements (for example, display elements in a liquid crystal panel) located close to the parallel-connected power supply line theoretically becomes zero. Thus, it is possible to cancel out noise occurring in the display elements and attributable to the illumination device for a display device.

Figure 7:
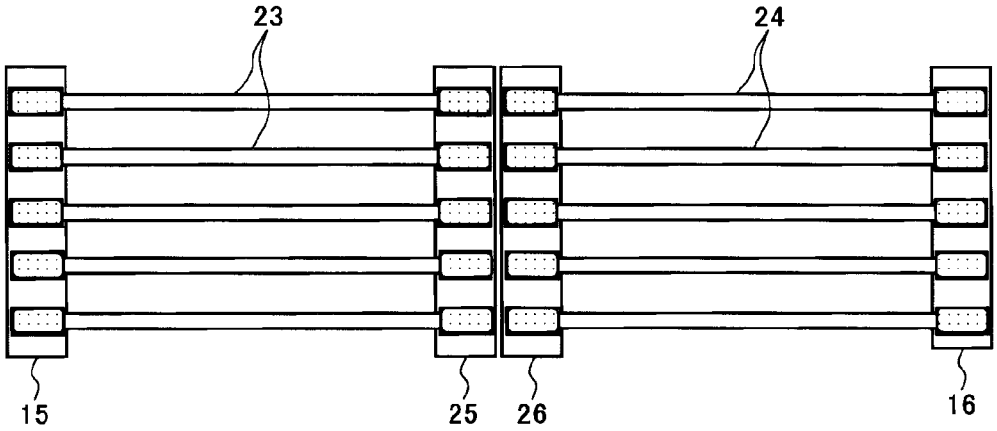
FIG. 7 is a diagram showing an example of the arrangement of the cold cathode lamps and the holders in the illumination device for a display device according to a preferred embodiment of the present invention.
Figure 8:
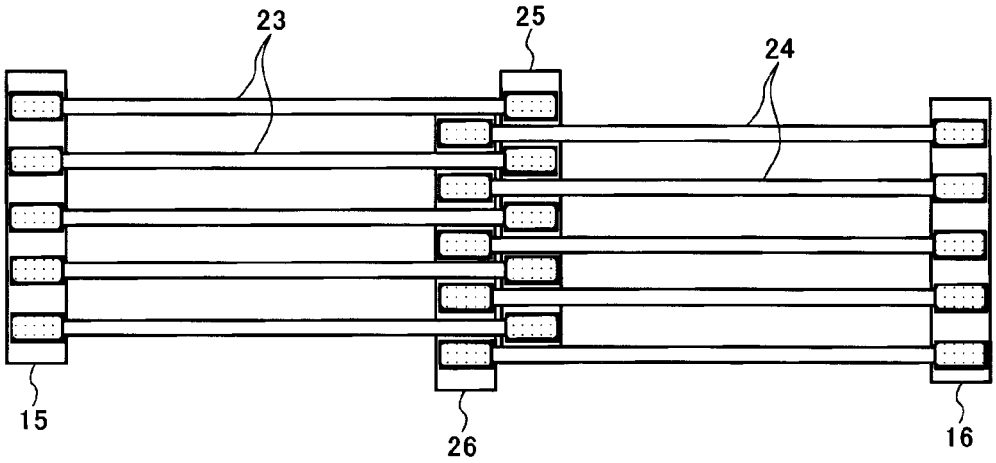
FIG. 8 is a diagram showing another example of the arrangement of the cold cathode lamps and the holders in the illumination device for a display device according to a preferred embodiment of the present invention.

In a case where the illumination device for a display device according to a preferred embodiment of the present invention is applied to a display device having a display screen over 37-inch visual size, in order to lower the discharge start voltages of the cold cathode lamps, for example, the cold cathode lamps in the illumination device for a display device according to a preferred embodiment of the present invention and the holders are preferably arranged as shown in FIGS. 7 and 8.

In an example of the arrangement of cold cathode lamps and holders shown in FIG. 7, the left front ends of left front cold cathode lamps 23 are held by the holders disposed in the left front end portion 15, and the right front ends of the left front cold cathode lamps 23 are held by the holders disposed in the first center portion 25; the right front ends of right front cold cathode lamps 24 are held by the holders disposed in the right front end portion 16, and the left front ends of the right front cold cathode lamps 24 are held by the holders disposed in the second center portion 26.

In an example of the arrangement of cold cathode lamps and holders shown in FIG. 8, the left front ends of left front cold cathode lamps 23 are held by the holders disposed in the left front end portion 15, and the right front ends of the left front cold cathode lamps 23 are held by the holders disposed in the first center portion 25; the right front ends of right front cold cathode lamps 24 are held by the holders disposed in the right front end portion 16, and the left front ends of the right front cold cathode lamps 24 are held by the holders disposed in the second center portion 26. The light emitting regions of the right front cold cathode lamps 24 are located over the first center section 25; the light emitting regions of the left front cold cathode lamps 23 are located over the second center section 26. With the example of the arrangement of the cold cathode lamps and the holders shown in FIG. 8, it is possible to prevent reduction in the amount of light emitted in the first and second center sections 25 and 26, as compared with the example of the arrangement of the cold cathode lamps and the holders shown in FIG. 7.

In both the example of the arrangement of the cold cathode lamps and the holders shown in FIG. 7 and the example of the arrangement of the cold cathode lamps and the holders shown in FIG. 8, a material having a higher reflectivity is preferably used for the surface layers of the right front ends (non-light-emitting regions) of the left front cold cathode lamps 23 and of the left front ends (non-light-emitting regions) of the right front cold cathode lamps 24. Moreover, the use of white material can reduce variations in the intensity of light emitted in the first and second center sections 25 and 26. Thus, more preferably, white material having a higher reflectivity is used.

A description will now be given of an example of the arrangement of power supplies in the example of the arrangement of the cold cathode lamps and the holder shown in FIG. 7 and in the example of the arrangement of the cold cathode lamps and the holder shown in FIG. 8.

Figure 9:
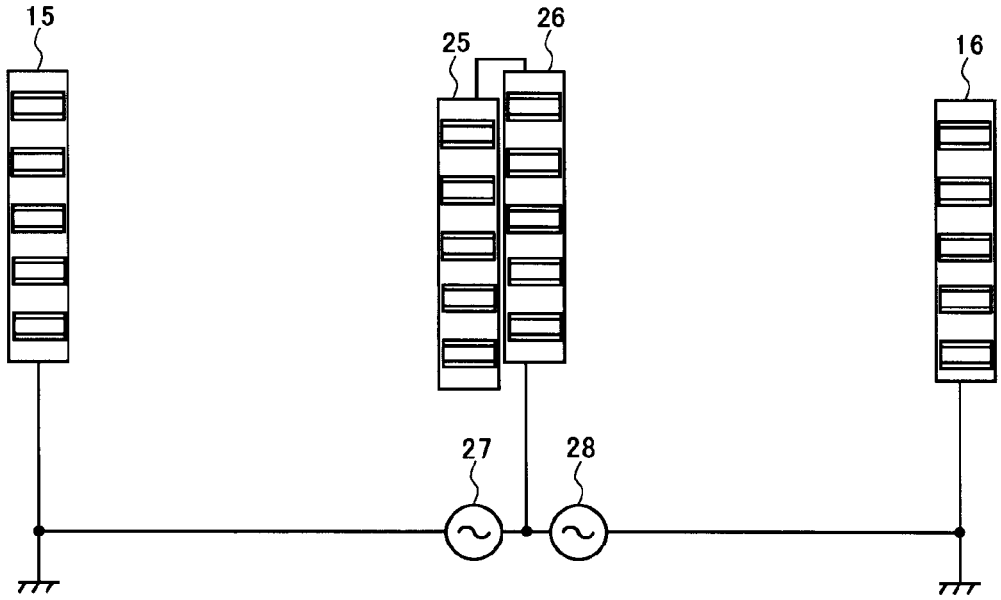
FIG. 9 is a diagram showing an example of the arrangement of power supplies both in the example of the arrangement of the cold cathode lamps and the holders shown in FIG. 7 and in the example of the arrangement of the cold cathode lamps and the holders shown in FIG. 8.

In an example of the arrangement of power supplies shown in FIG. 9, holders disposed in the left front end portion 15 of an illumination unit and connected together are connected to one end of the power supply 27 and grounded; holders disposed in the right front end portion 16 of the illumination unit and connected together are connected to one end of the power supply 28 and grounded. Holders disposed in the first center section 25 of the illumination unit and holders disposed in the second center section 26 of the illumination unit are connected together and are connected to the other ends of the power supplies 27 and 28. The power supplies 27 and 28 are provided behind the illumination unit; they output an alternating-current voltage having a frequency of several tens of kilohertz. Voltages in phase with each other are outputted from the other ends of the power supplies 27 and 28.

Figure 10:
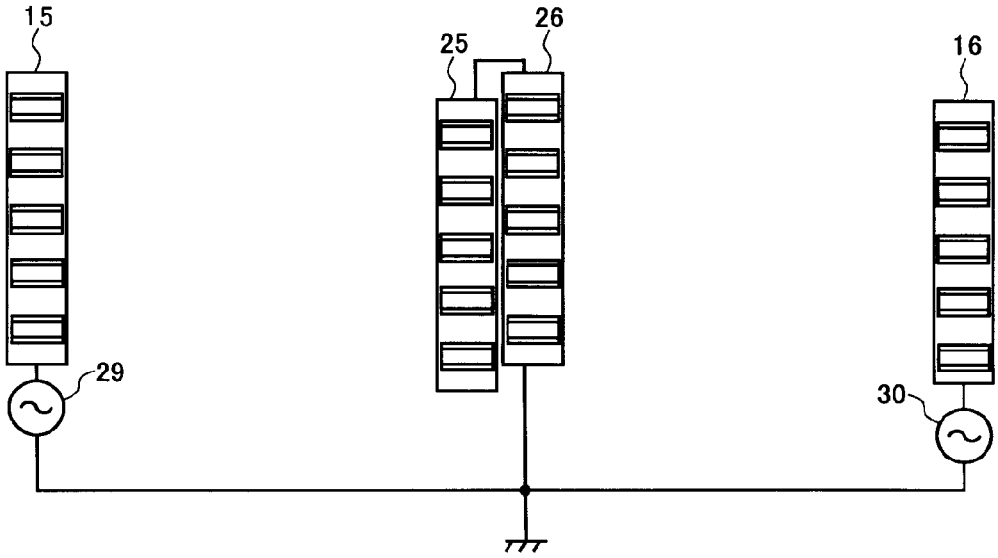
FIG. 10 is a diagram showing another example of the arrangement of power supplies both in the example of the arrangement of the cold cathode lamps and the holders shown in FIG. 7 and in the example of the arrangement of the cold cathode lamps and the holders shown in FIG. 8.

In an example of the arrangement of power supplies shown in FIG. 10, holders disposed in the left front end portion 15 of an illumination unit and connected together are connected to one end of the power supply 29; holders disposed in the right front end portion 16 of the illumination unit and connected together are connected to one end of the power supply 30. Holders disposed in the first center section 25 of the illumination unit and holders disposed in the second center section 26 of the illumination unit are connected together and are connected to the other ends of the power supplies 29 and 30 and grounded. The power supplies 29 and 30 are provided behind the illumination unit and output an alternating-current voltage having a frequency of several tens of kilohertz. Voltages in phase with each other or out of phase with each other are outputted from the one ends of the power supplies 29 and 30.

Figure 11:
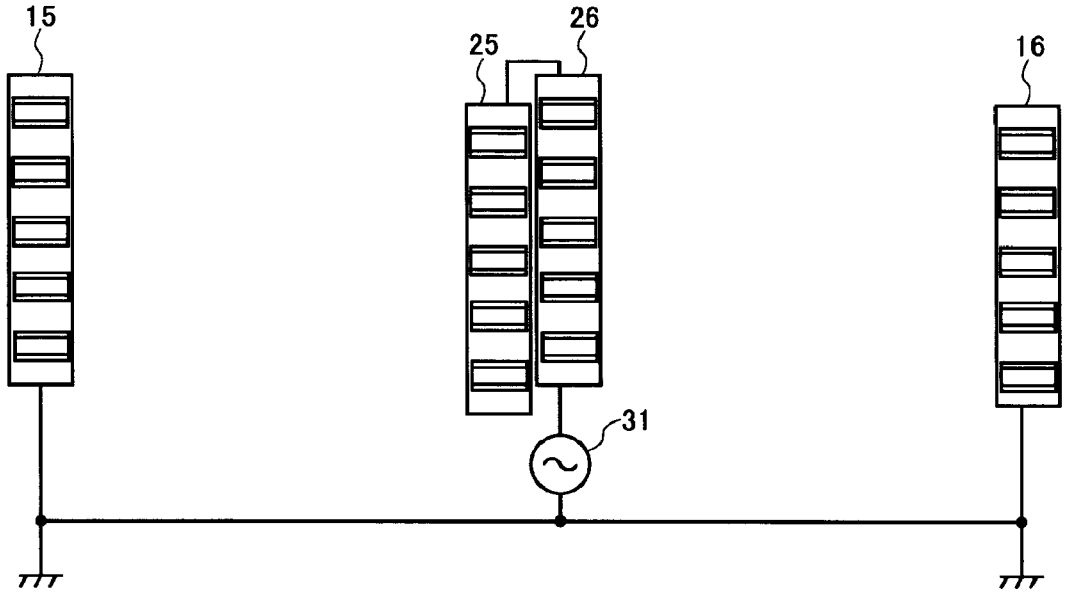
FIG. 11 is a diagram showing another example of the arrangement of a power supply both in the example of the arrangement of the cold cathode lamps and the holders shown in FIG. 7 and in the example of the arrangement of the cold cathode lamps and the holders shown in FIG. 8.
Figure 12A:
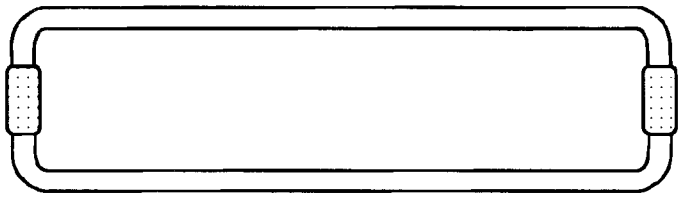
FIG. 12A is a diagram showing another modified example of the cold cathode lamp according to a preferred embodiment of the present invention.
Figure 12B:
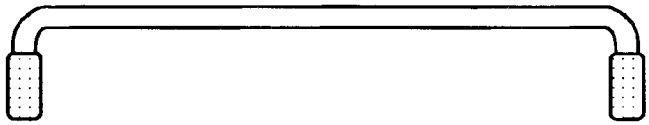
FIG. 12B is a diagram showing another modified example of the cold cathode lamp according to a preferred embodiment of the present invention.
Figure 12C:
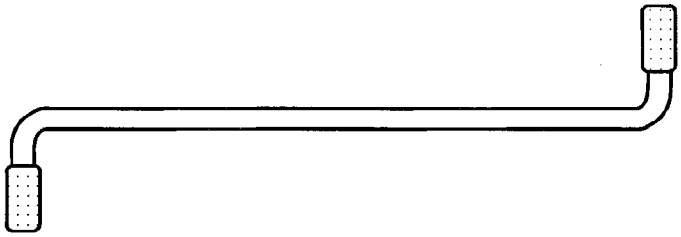
FIG. 12C is a diagram showing another modified example of the cold cathode lamp according to a preferred embodiment of the present invention.
Figure 12D:
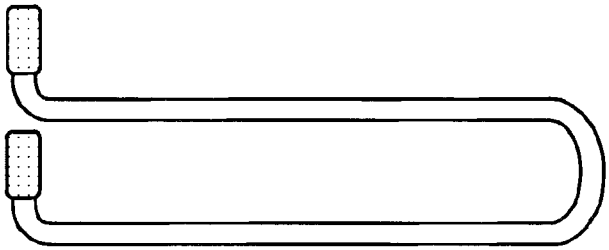
FIG. 12D is a diagram showing another modified example of the cold cathode lamp according to a preferred embodiment of the present invention.
Figure 12E:
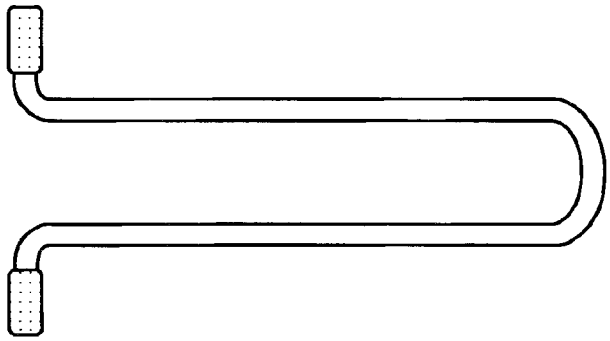
FIG. 12E is a diagram showing another modified example of the cold cathode lamp according to a preferred embodiment of the present invention.
Figure 12F:
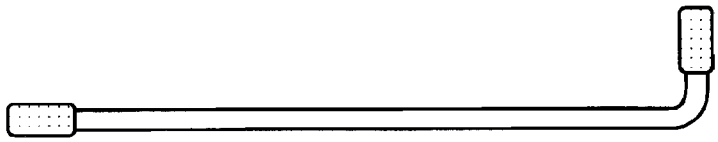
FIG. 12F is a diagram showing another modified example of the cold cathode lamp according to a preferred embodiment of the present invention.

In an example of the arrangement of power supplies shown in FIG. 11, holders disposed in the left front end portion 15 of an illumination unit and connected together are connected to one end of the power supply 31 and grounded; holders disposed in the right front end portion 16 of the illumination unit and connected together are connected to the one end of the power supply 31 and grounded. Holders disposed in the first center section 25 of the illumination unit and holders disposed in the second center section 26 of the illumination unit are connected together and are connected to the other end of the power supply 31. The power supply 31 is provided behind the illumination unit and outputs an alternating-current voltage having a frequency of several tens of kilohertz.

With one of the examples of the arrangement of the power supplies shown in FIGS. 9 to 11, it is possible to reduce the wiring lengths of high-voltage lines that carry high voltage. This helps stabilize lamp current and reduce power dissipation.

In the cold cathode lamp according to a preferred embodiment of the present invention, as shown in FIGS. 12A to 12F, part or the whole of the axes of external electrode portions (where the external electrodes on the glass tube are formed) may be substantially perpendicular to the axis of a light emitting section along the main direction in which the light emitting section is arranged. In this way, even if the areas of the opposite electrode and the external electrode in the cold cathode lamp according to a preferred embodiment of the present invention are increased so that the capacitance of the capacitor defined by the opposite electrode and the external electrode in the cold cathode lamp of the invention is increased or other advantages are achieved, the increase of the width of a frame in the illumination device for a display device can be prevented.

Figure 13A:
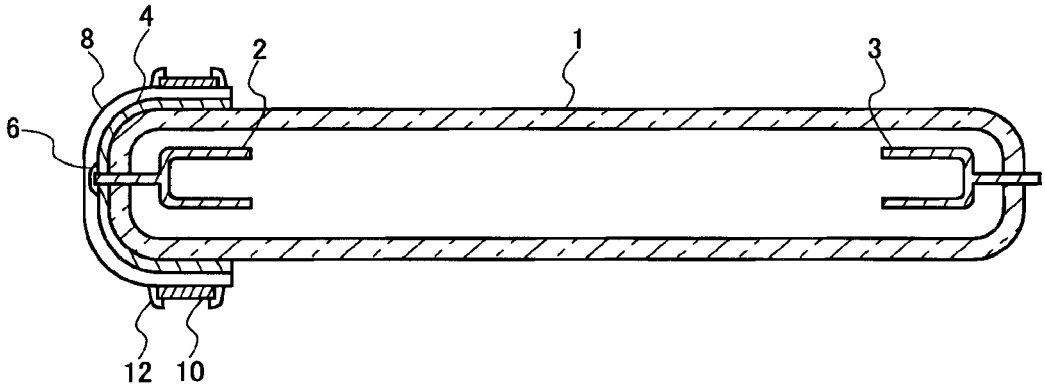
FIG. 13A is a diagram showing another modified example of the cold cathode lamp according to a preferred embodiment of the present invention.
Figure 13B:
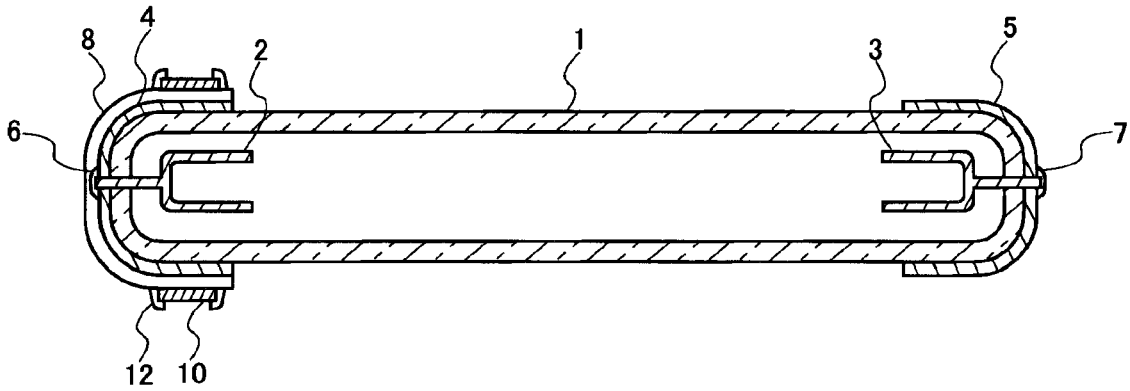
FIG. 13B is a diagram showing another modified example of the cold cathode lamp according to a preferred embodiment of the present invention.

In the preferred embodiment described above, the two external electrodes are preferably provided in the cold cathode lamp of the present invention. However, since a nonlinear positive impedance characteristic can be obtained even when only one external electrode is provided, the cold cathode lamp according to a preferred embodiment of the present invention may be provided with only one external electrode. For example, when the cold cathode lamp shown in FIG. 1 and according to a preferred embodiment of the present invention is modified so as to have only one external electrode, the modified cold cathode lamp is shown in FIG. 13A. In the cold cathode lamp shown in FIG. 13A, since the end of the lamp on the side of the internal electrode 3 is connected to a power supply circuit through wiring harness (also called lead wires) and connectors, the mounting and removal of the cold cathode lamp is time-consuming. In the preferred embodiment described above, the two insulating layers are provided in the cold cathode lamp of the present invention. However, since a nonlinear positive impedance characteristic can be obtained even when only one insulating layer is provided, the cold cathode lamp according to a preferred embodiment of the present invention may be provided with only one insulating layer. For example, when the cold cathode lamp shown in FIG. 1 and according to a preferred embodiment of the present invention is modified so as to have only one insulating layer, the modified cold cathode lamp is shown in FIG. 13B. In the cold cathode lamp shown in FIG. 13B, since at the end of the lamp on the side of the internal electrode 3, the external electrode can be held by the holder through the elastic action of the holder formed by an elastic metal member (made of, for example, spring steel), the mounting and removal of the cold cathode lamp is facilitated.

In the preferred embodiment described above, the two corona discharge prevention insulating layers preferably are provided. However, even when only one corona discharge prevention insulating layer is provided, the generation of corona discharge can be prevented on the opposite electrode whose outer edges are covered by the corona discharge prevention insulating layer. Thus, the cold cathode lamp according to a preferred embodiment of the present invention may be provided with only one corona discharge prevention insulating layer. In the preferred embodiment described above, the corona discharge prevention insulating layer preferably covers the entire outer edges of the opposite electrode. However, even when the corona discharge prevention insulating layer covers at least part of the outer edges of the opposite electrode, the generation of corona discharge can be suppressed in the covered portion. Thus, in the cold cathode lamp of the invention, the corona discharge prevention insulating layer may cover part of the outer edges of the opposite electrode.

A display device according to a preferred embodiment of the present invention is provided with the above-described illumination device for a display device according to another preferred embodiment of the present invention and a display panel. Specific examples of the display device according to preferred embodiments of the present invention, for example, include a transmissive liquid crystal display device in which the illumination device for a display device according to preferred embodiments of the present invention is used as a backlight unit, and a liquid crystal display panel is provided in front of the illumination device for a display device.

The cold cathode lamp according to a preferred embodiment of the present invention can be applied as an illumination source incorporated in an illumination device for a display device or an illumination source incorporated in various devices.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A cold cathode lamp having electric power supplied through first and second conducting members disposed externally, the cold cathode lamp comprising:

an insulating tube made of a light-transmissive insulating material;

a first internal electrode disposed inside the insulating tube;

a second internal electrode disposed inside the insulating tube;

a first external electrode disposed outside the insulating tube and connected to the first internal electrode so as to have a same potential as a potential of the first internal electrode;

a first insulating member;

a first opposite electrode opposite the first external electrode with the first insulating member interposed therebetween; and a first insulating layer covering at least a portion of an outer edge of the first opposite electrode; wherein the first conducting member is electrically connected to the first opposite electrode when the cold cathode lamp is mounted.

2. The cold cathode lamp of claim 1, further comprising:

a second external electrode disposed outside the insulating tube and connected to the second internal electrode so as to have a same potential as a potential of the second internal electrode;

a second insulating member;

a second opposite electrode opposite the second external electrode with the second insulating member interposed therebetween; and a second insulating layer covering at least a portion of an outer edge of the second opposite electrode; wherein the second conducting member is electrically connected to the second opposite electrode when the cold cathode lamp is mounted.

3. The cold cathode lamp of claim 2, wherein entire upper and lower surfaces of the first external electrode are respectively covered by the insulating tube and the first insulating member, and entire upper and lower surfaces of the second external electrode are respectively covered by the insulating tube and the second insulating member.

4. The cold cathode lamp of claim 2, wherein the first opposite electrode has a projection, and the first conducting member and the projection of the first opposite electrode make contact with each other when the cold cathode lamp is mounted, and the second opposite electrode has a projection, and the second conducting member and the projection of the second opposite electrode make contact with each other when the cold cathode lamp is mounted.

5. The cold cathode lamp of claim 1, wherein entire upper and lower surfaces of the first external electrode are respectively covered by the insulating tube and the first insulating member.

6. The cold cathode lamp of claim 1, wherein the first opposite electrode has a projection, and the first conducting member and the projection of the first opposite electrode make contact with each other when the cold cathode lamp is mounted.

7. An illumination device for a display device, the illumination device comprising:

the cold cathode lamp according to claim 1;

a first conducting member and a second conducting member; and a power supply supplying electric power to the cold cathode lamp through the first and second conducting members.

8. The illumination device for a display device of claim 7, wherein as said cold cathode lamp, there are provided a plurality of cold cathode lamps, and a portion or a whole of the plurality of cold cathode lamps is electrically connected in parallel.

9. The illumination device for a display device of claim 8, wherein a voltage applied to first internal electrodes in the cold cathode lamps connected in parallel is substantially 180 degrees out of phase with a voltage applied to second internal electrodes in the cold cathode lamps connected in parallel.

10. A display device comprising the illumination device for a display device of claim 7.

* * * * *